US009875859B2

(12) United States Patent
Lee et al.

(10) Patent No.: US 9,875,859 B2
(45) Date of Patent: Jan. 23, 2018

(54) HIGH VOLTAGE RELAY DEVICE

(71) Applicant: LSIS Co., LTD., Anyang-si, Gyeonggi-do (KR)

(72) Inventors: Kwangsik Lee, Anyang-si (KR); Moonjo Kang, Seoul (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/160,430

(22) Filed: May 20, 2016

(65) Prior Publication Data

US 2017/0032913 A1 Feb. 2, 2017

(30) Foreign Application Priority Data

Jul. 31, 2015 (KR) ..... 10-2015-0109086

(51) Int. Cl.

| | |
|---|---|
| ***H01H 33/60*** | (2006.01) |
| ***H01H 9/38*** | (2006.01) |
| ***H01H 9/44*** | (2006.01) |
| ***H01H 50/54*** | (2006.01) |
| *H01H 51/06* | (2006.01) |
| *H01H 50/02* | (2006.01) |

(52) U.S. Cl.

CPC ..... *H01H 9/38* (2013.01); *H01H 9/443* (2013.01); *H01H 50/546* (2013.01); *H01H 51/065* (2013.01); *H01H 2050/025* (2013.01)

(58) Field of Classification Search

CPC .... H01H 33/60; H01H 33/182; H01H 50/546; H01H 2050/025; H01H 50/38; H01H 50/54; H01H 51/065; H01H 9/341; H01H 9/38; H01H 9/443

USPC ..... 335/201

See application file for complete search history.

(56) References Cited

U.S. PATENT DOCUMENTS 4,560,848 A * 12/1985 Arimoto ..... H01H 33/182 218/23

2013/0063232 A1* 3/2013 Takaya ..... H01H 9/443 335/201

(Continued)

FOREIGN PATENT DOCUMENTS

| | | |
|---|---|---|
| JP | 4038950 | 1/2008 |
| JP | 2010073352 | 4/2010 |

(Continued)

OTHER PUBLICATIONS

Korean Search Report for Korean Patent Application No. 10-2015-0109086, dated Oct. 8, 2015, 4 pages.

*Primary Examiner* — Bernard Rojas

(74) *Attorney, Agent, or Firm* — K&L Gates, LLP

(57) ABSTRACT

A high voltage relay device according to the present invention includes fixed contacts, a movable contact provided at one side of the fixed contacts and contactable with or separated from the fixed contacts, fixed-side arc electrodes coupled to the fixed contacts, and a movable-side arc electrode coupled to one side of the movable contact and contactable with or separated from the fixed-side arc electrodes when the movable contact is brought into contact with or separated from the fixed contacts, whereby a generation of arc from primary electrodes when current flows and is cut off can be prevented so as to enhance reliability of the primary electrodes, and also usage of specialized materials may result in reduction of material costs.

15 Claims, 5 Drawing Sheets

(56) References Cited

U.S. PATENT DOCUMENTS

| | | | | |
|---|---|---|---|---|
| 2013/0335177 | A1* | 12/2013 | Enomoto | H01H 1/20 335/192 |
| 2015/0022291 | A1* | 1/2015 | Kashimura | H01H 9/443 335/131 |
| 2015/0194284 | A1 | 7/2015 | Uruma et al. | |

FOREIGN PATENT DOCUMENTS

| | | |
|---|---|---|
| JP | 2012199137 | 10/2012 |
| JP | 5673878 | 2/2015 |
| WO | 2012060090 | 5/2012 |

* cited by examiner

HIGH VOLTAGE RELAY DEVICE

CROSS-REFERENCE TO RELATED APPLICATION

Pursuant to 35 U.S.C. §119(a), this application claims the benefit of earlier filing date and right of priority to Korean Patent Application No. 10-2015-0109086, filed on Jul. 31, 2015, the contents of which are all hereby incorporated by reference herein in its entirety.

BACKGROUND OF THE INVENTION

1. Field of the Invention

This specification relates to a high voltage relay device, and more particularly, a high voltage relay device having arc electrodes in addition to primary electrodes.

2. Background of the Invention

Hybrid electric vehicles (HEVs) and fuel cell electric vehicles (FCEVs), which replace currently-used diesel or gasoline vehicles, are expected to be key issues in the development of vehicle engines, in the aspects of running out of oil riches and eco-friendly environment.

The HEV uses the existing engine and a battery as power sources. At an initial operation, the HEV is accelerated by using electric energy produced using battery power, and recharging/discharging of the battery is repeatedly performed using an engine and a brake according to a driving speed. The HEV exhibits higher fuel efficiency when a percentage of using the battery as a power source is higher. Accordingly, it is expected that a capacity of the battery is gradually increasing according to consumers' demands. In order to increase the capacity of the battery, the most convenient way is to increase a voltage. So, usage voltages of recently-produced batteries have increased from 12V, which is a conventionally used voltage level, to 200~300 V, and in future, a further increase is expected. This requires for high insulating capabilities of peripheral electric devices. Accordingly, a high voltage relay which functions to power on/off a high voltage battery is newly developed now and high reliability of the high voltage relay is also required.

FIG. 1 is a longitudinal sectional view illustrating a high voltage relay for an electric vehicle according to the related art.

As illustrated in FIG. 1, a high voltage relay for an electric vehicle according to the related art includes a fixed electrode 1 having a fixed contact 11, a movable contact arm 20 having a movable contact 21 which is contactable with or separated from the fixed contact 11, an arc-extinguishing unit 3 for extinguishing arc A that is generated upon a contact or separation between the fixed electrode 1 and the movable contact arm 20, and a driving unit 4 for driving the movable contact arm 2.

The fixed electrode 1 is provided as a pair each having the fixed contact 11 on its end portion.

The movable contact arm 2 is formed in the shape of a flat plate, and provided with the movable contact 21 at a surface facing the fixed contacts 11.

The arc-extinguishing unit 3 includes a case 31 forming an arc-extinguishing space of the arc A using an insulating material, and a permanent magnet (not illustrated) for controlling the arc A generated between the fixed electrodes 1 and the movable contact arm 2. The case 31 is formed of an insulating material, for example, ceramic, and the pair of fixed electrodes 1 is coupled to an upper portion of the case 31. The movable contact arm 2 is installed within the case 31 in a manner of being simultaneously brought into contact with or spaced apart from the fixed contacts 11, and a downwardly-extending connection shaft 46 is coupled to a center of the movable contact arm 2.

The driving unit 4 includes a bobbin 41 in a cylindrical shape, an excitation coil 42 wound around a circumference of the bobbin 41, a yoke 43 disposed below the case 31, a fixed core 44 disposed within the bobbin 41, a movable core 45 brought into contact with or separated from the fixed core 44, a connection shaft 46 having one end connected to the movable contact arm 2 and another end connected to the movable core 45 through the fixed core 44, and a return spring 47 applying an elastic force to the movable core 45 to be separated from the fixed core 44.

The high voltage relay for the electric vehicle according to the related art will operate in the following manner.

That is, when power is applied to the excitation coil 42, the excitation coil 42 generates an electronic attractive force. The movable core 45 is then moved upward until being brought into contact with the fixed core 44, due to the electronic attractive force. The movable contact arm 2 connected to the movable core 45 by the connection shaft 46 is moved upward, in response to the upward movement of the movable core 45, such that the movable contact 21 of the movable contact arm 2 is brought into contact with the fixed contacts 11. Accordingly, a primary circuit which has been open may be closed.

On the other hand, when power supplied to the excitation coil 42 is cut off, the electronic attractive force is not generated from the excitation coil 42 any more. Accordingly, the return spring 47 which is interposed between the fixed core 44 and the movable core 45 returns to its original state. During this, the movable core 45 is pushed down. The movable contact arm 2 is also moved down along with the movable core 45, such that the movable contact 21 is separated from the fixed contacts 11. Consequently, the primary circuit is shorted or open.

In this instance, while the fixed contacts 11 and the movable contact 21 are brought into contact with or separated from each other, the arc A is always generated between the fixed contacts 11 and the movable contact 21. As such, both conduction and arc extinguishment are caused between the fixed contacts 11 and the movable contact 21, and thus the fixed contacts 11 and the movable contact 21 should be formed of a material which simultaneously satisfies electric conductivity and resistance to arc, in view of ensuring reliability. However, the two properties are difficult to be simultaneously satisfied due to a characteristic of a material, and a material satisfying them is very expensive and difficult to be processed.

SUMMARY OF THE INVENTION

Therefore, an aspect of the detailed description is to provide a high voltage relay device, which has an improved contact structure by separately employing electrodes managing conduction of the relay and electrodes managing arc extinguishment, respectively, and which is relatively cheap and easily processed while satisfying both of electric conductivity and durability by using materials which are specialized for the electric conductivity and the durability, respectively.

To achieve these and other advantages and in accordance with the purpose of this specification, as embodied and broadly described herein, there is provided a high voltage relay device, including fixed contacts, a movable contact provided at one side of the fixed contacts and contactable with or separated from the fixed contacts, fixed-side arc electrodes coupled to the fixed contacts, and a movable-side arc electrode coupled to one side of the movable contact and contactable with or separated from the fixed-side arc electrodes when the movable contact is brought into contact with or separated from the fixed contacts.

Here, the fixed-side arc electrodes and the movable-side arc electrode may be brought into contact with each other before the fixed contacts and the movable contact are brought into contact with each other and separated from each other after the fixed contacts and the movable contact are separated from each other.

The least interval between the fixed-side arc electrodes and the movable-side arc electrode may be shorter than the least interval between the fixed contacts and the movable contact.

An inner circumferential surface of the movable-side arc electrode may be brought into contact with outer circumferential surfaces of the fixed-side arc electrodes in a sliding manner.

The fixed-side arc electrodes and the movable-side arc electrode may be made of a material with heat resistance or abrasion resistance superior to that of a material forming the fixed contacts and the movable contact.

The fixed contacts and the movable contact may be made of a material with conductivity superior to that of a material forming the fixed-side arc electrodes and the movable-side arc electrode.

To achieve these and other advantages of the present invention, there is provided a high voltage relay device, including fixed electrodes each having a fixed contact, a movable contact arm having a movable contact that performs a relative motion with respect to the fixed contacts of the fixed electrodes to be contactable with or separated from the fixed contacts, an arc-extinguishing unit provided to accommodate the fixed electrodes and the movable contact arm and capable of extinguishing arc generated when the fixed contacts and the movable contact are brought into contact with or separated from each other, a driving unit capable of driving the movable contact arm, fixed-side arc electrodes coupled to the fixed electrodes, and a movable-side arc electrode coupled to the movable contact arm and contactable with or separated from the fixed-side arc electrodes so as to configure a part of the arc-extinguishing unit.

Here, a stepped surface may be formed on at least one of an outer circumferential surface of each of the fixed electrodes and an outer circumferential surface of the movable contact arm, and each of the fixed-side arc electrodes or the movable-side arc electrode may be coupled to the stepped surface in an inserting manner.

The least interval between the fixed-side arc electrodes and the movable-side arc electrode may be shorter than the least interval between the fixed contacts and the movable contact, and an inner diameter of the movable-side arc electrode may be greater than an outer diameter of each of the fixed-side arc electrodes, such that an inner circumferential surface of the movable-side arc electrode and an outer circumferential surface of each of the fixed-side arc electrodes are brought into contact with each other in an overlapping manner.

Guide surfaces each in an inclined or curved shape may be formed at a lower edge of the outer circumferential surface of each of the fixed-side arc electrodes and an upper edge of the inner circumferential surface of the movable-side arc electrode, respectively.

The fixed-side arc electrodes and the movable-side arc electrode may be formed in a cylindrical shape.

At least one of each of the fixed-side arc electrodes and the movable-side arc electrode may be coupled to only a part of an outer circumferential surface of the corresponding fixed electrode or movable contact arm.

The high voltage relay device according to the present invention may employ arc electrodes managing arc extinguishment, in addition to primary electrodes managing conduction, and the primary electrodes and the arc electrodes may be made of materials with electric conductivity and resistance to arc, respectively. This may prevent a generation of arc from the primary electrodes when current flows or is cut off, thereby enhancing reliability of the primary electrodes. Also, the usage of such specialized materials may result in reduction of material costs.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of a high voltage relay device according to the present invention, with reference to the accompanying drawings.

Figure 1:
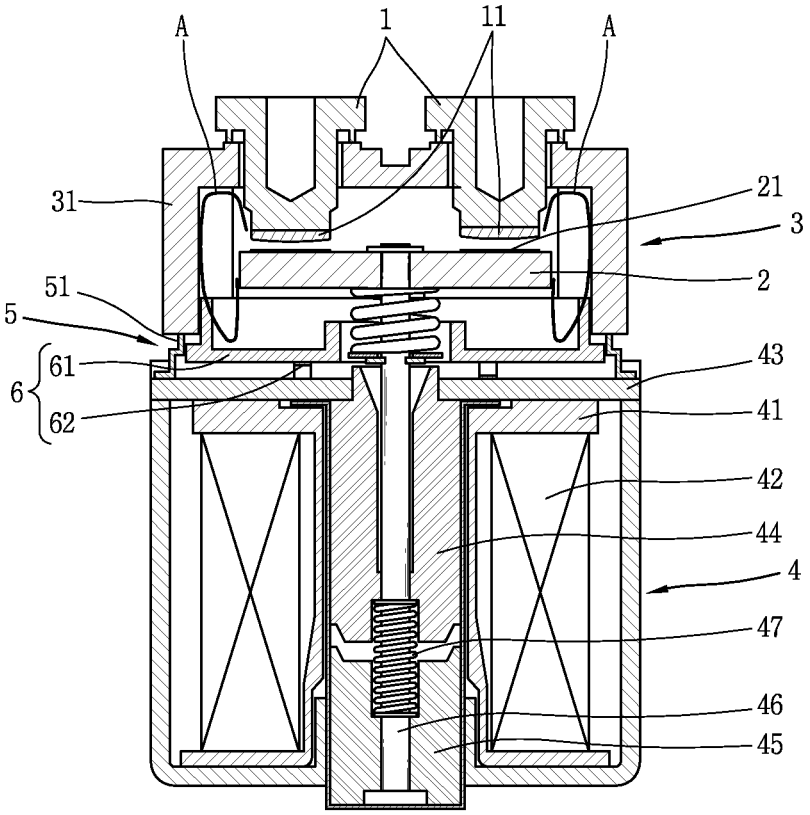
FIG. 1 RELATED ART
FIG. 1 is a longitudinal sectional view illustrating a high voltage relay for an electric vehicle according to the related art.
Figure 2:
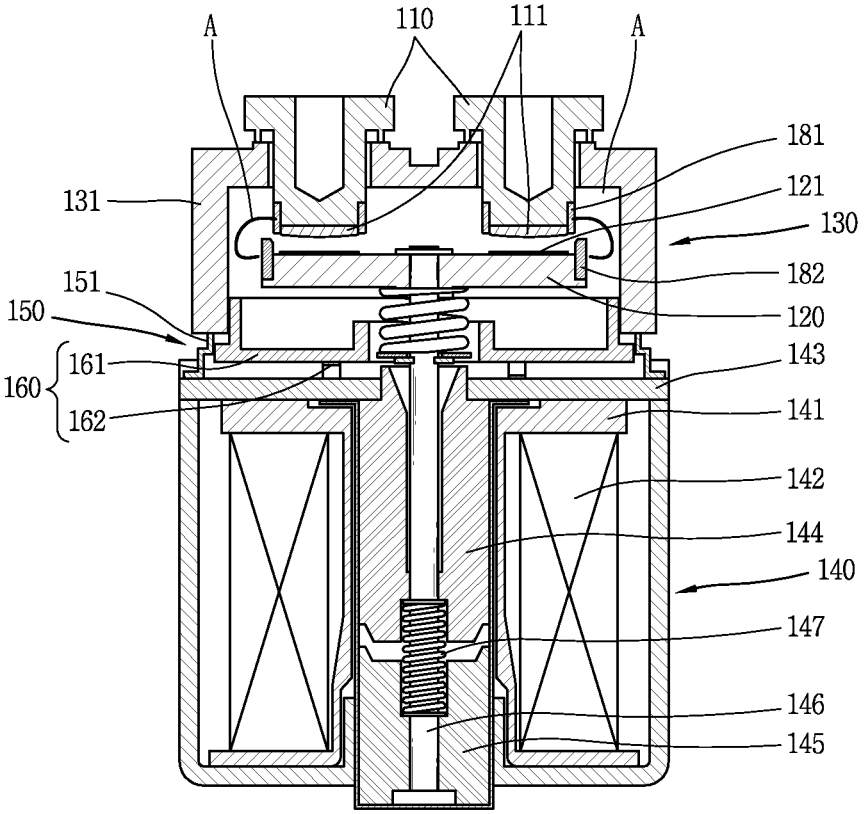
FIG. 2 is a longitudinal sectional view illustrating one embodiment of a high voltage relay for an electric vehicle in accordance with the present invention.
Figure 3:
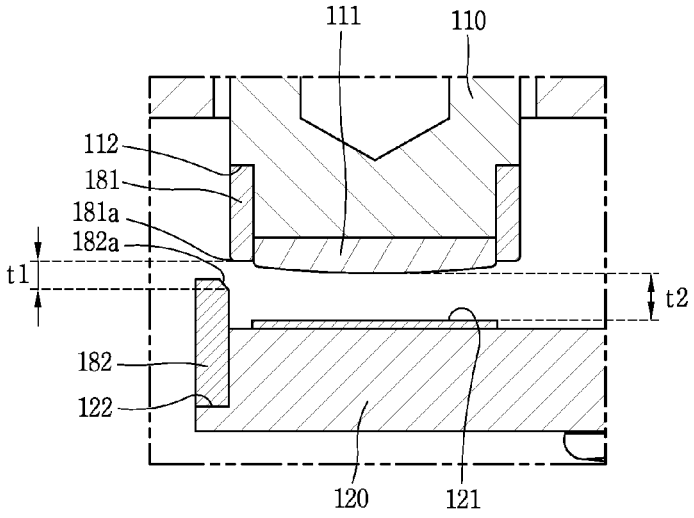
FIG. 3 is a longitudinal sectional view illustrating relationship between a contact and an arc electrode of FIG. 2.
Figure 4:
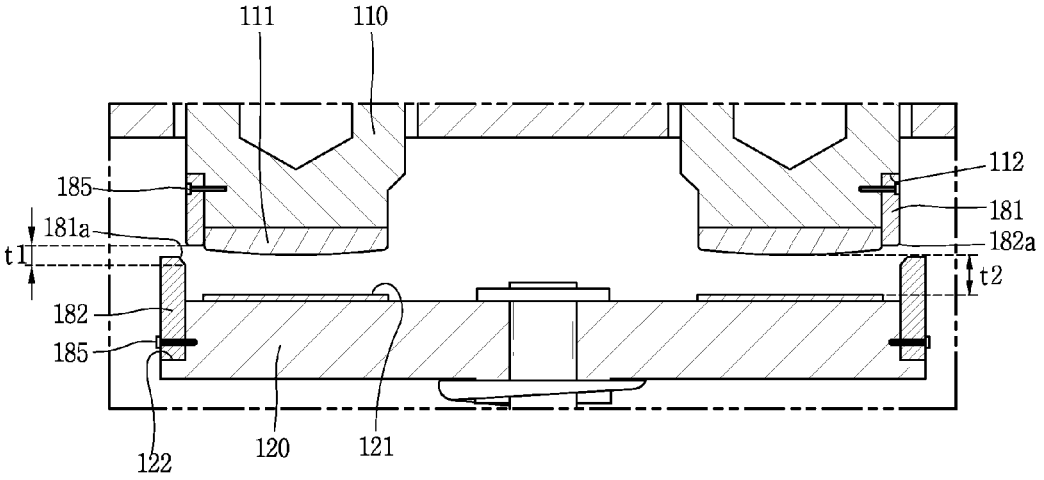
FIG. 4 is a longitudinal sectional view illustrating another embodiment related to fixed-side arc electrodes and movable-side arc electrodes according to FIG. 2.

FIG. 2 is a longitudinal sectional view illustrating one embodiment of a high voltage relay device for a vehicle in accordance with the present invention, FIG. 3 is a longitudinal sectional view illustrating relationship between a contact and an arc electrode of FIG. 2, and FIG. 4 is a longitudinal sectional view illustrating another embodiment related to fixed-side arc electrodes and movable-side arc electrodes according to FIG. 2.

As illustrated, the high voltage relay device for the electric vehicle according to this exemplary embodiment may include an arc-extinguishing unit 130 accommodating therein fixed contacts 111 and a movable contact 121, and extinguishing arc generated when the fixed contacts 111 and the movable contact 121 are brought into contact with or separated from each other, a driving unit 140 provided at one side of the arc-extinguishing unit 130 and allowing the movable contact 121 to move, a sealing unit 150 sealing a space or a gap between the arc-extinguishing unit 130 and the driving unit 140, and an arc interrupting unit 160 disposed between the arc-extinguishing unit 130 and the driving unit 140 within the sealing unit 150 and preventing a leakage of the arc A into the sealing unit 150.

The arc-extinguishing unit 130 may include a case 131 made of an insulating material and forming an inner space for extinguishing the arc, and a permanent magnet (not illustrated) controlling the arc A generated between the fixed contacts 111 and the movable contact 121. The case 131 may be formed of an insulating material, such as ceramic, and a plurality of fixed electrodes 110 each having a fixed contact 111 may be coupled to an upper portion of the case 131.

A movable contact arm 120 having the movable contact 121 which is simultaneously brought into contact with or separated from the fixed contacts 111 may be installed within the case 131, and a connection shaft 146 which downwardly extends to be connected to the driving unit 140 may be coupled to a center of the movable contact arm 120. The connection shaft 146 will be explained later.

The driving unit 140 may include a bobbin 141 in a cylindrical shape, an excitation coil 142 wound on a circumference of the bobbin 141, a yoke 143 disposed below the case 131, a fixed core 144 disposed at an inner side of the bobbin 141, a movable core 145 brought into contact with and separated from the fixed core 144, a connection shaft 146 having one end connected to the movable contact 121 and another end connected to the movable core 145 through the fixed core 145, and a return spring 147 applying an elastic force to the movable core 145 to be separated from the fixed core 144.

The sealing unit 150 may be provided with a seal cup 151 which is made of a metal material and seals the inner space between the arc-extinguishing unit 130 and the driving unit 140 so as to prevent a leakage of gas within such inner space. The seal cup 151 may be formed in a shape of a round cup. An upper end of the seal cup 151 may be closely adhered onto a lower surface of the case 131 of the arc-extinguishing unit 130 and a lower end thereof may be closely adhered onto an upper surface of the yoke 143 of the driving unit 140.

The arc-interrupting unit 160 may include a plate 161 formed in approximately the same shape as an open surface of the case 131 of the arc-extinguishing unit 130, and a sealing protrusion 162 protruding from an upper surface of the plate 161 toward the case 131 by a predetermined height so as to be slidably inserted into an inner circumferential surface of the case 131.

The high voltage relay device for the electric vehicle according to this embodiment will operate in the following manner.

That is, when power is applied to the excitation coil 142 of the driving unit 140, the movable core 145 may be moved in a direction of being contactable with the fixed core 144. The connection shaft 146 integrally coupled to the fixed core 144 may be moved accordingly and the movable contact 121 may be brought into contact with the fixed contacts 111, thereby allowing a flow of current.

On the other hand, when power supplied to the excitation coil 142 is cut off, the movable core 144 may be separated from the fixed core 144 by an elastic force of the return spring 147, and simultaneously the movable contact 121 may be separated from the fixed contacts 111.

In this instance, arc A in a streamline shape may be generated between the fixed contacts 111 and the movable contact 121. Here, since the case 131 is formed of the insulating material, this arc A may be locked in the inner space of the case 131 and apt to be induced to the seal cup 151 made of the metal material. However, the arc A may be prevented from being induced to the seal cup 151 by the arc-interrupting unit 160 which surrounds the inner circumferential surface of the seal cup 151, namely, the open surface of the case 131.

Meanwhile, according to this embodiment, as illustrated in FIGS. 2 and 3, arc electrodes 181 and 182 which serve to extinguish arc may be provided at circumferences of the fixed contacts 111 and the movable contact 121, respectively. In this instance, the fixed contacts 111 and the movable contact 121 may manage conduction (flow of current), and the arc electrodes 181 and 182 may manage arc extinguishment. Accordingly, the fixed contacts 111 and the movable contact 121 may be made of a material facilitating the conduction, and the arc electrodes 181 and 182 may be made of a material facilitating the arc extinguishment.

For example, the fixed contacts 111 and the movable contact 121 may be made of copper or copper alloy that a material such as molybdenum or zirconium is contained in copper, taking into account conductivity or heat resistance. On the other hand, the arc electrodes 181 and 182 may be made of copper alloy that a material, such as tungsten, which has relatively higher intensity than the material forming the fixed contacts 111 or the movable contact 121, is contained in copper, taking into account abrasion resistance or heat resistance.

The arc electrodes 181 and 182 should be brought into contact with the fixed contacts 111 before the movable contact 121 is brought into contact with the fixed contacts 111 and should be separated from the fixed contacts 111 after the movable contact 121 is separated from the fixed contacts 111. Consequently, the arc electrodes 181 and 182 may preferably be formed to protrude higher than a cross section of the fixed contacts 111 or the movable contact 121. That is, as illustrated in FIG. 3, the least interval t1 between the fixed-side arc electrode and the movable-side arc electrode may be shorter than the least interval t2 between the fixed contacts 111 and the movable contact 121.

To this end, the arc electrodes may include a plurality of fixed-side arc electrodes 181 coupled to the fixed electrodes 110, and a movable-side arc electrode 182 coupled to the movable contact arm 120. The fixed-side arc electrode 182 coupled to the movable contact arm 120. The fixed-side arc electrodes 181 and the movable-side arc electrode 182 may be brought into contact with or separated from each other in a sliding manner. Here, the fixed-side arc electrodes 181 and the movable-side arc electrode 182 may be coupled in a press-fitting, welding or bolting manner.

Since the fixed-side arc electrodes 181 and the movable-side arc electrode 182 are brought into contact with or separated from each other in the sliding manner, the fixed-side arc electrodes 181 and the movable-side arc electrode 182 should be supported in a sliding direction to maintain reliability. For this, each of the fixed-side arc electrodes 181 and the movable-side arc electrode 182 may be formed in a cylindrical shape, and stepped surfaces 112 and 122, to which the fixed-side arc electrodes 182 and the movable-side arc electrode 182 are coupled in an inserting manner, respectively, may be formed at an outer circumferential surface of the fixed electrode 110 and an outer circumferential surface of the movable contact arm 120, respectively.

An outer diameter of each of the fixed-side arc electrodes 181 may be the same as or slightly smaller than an inner diameter of the movable-side arc electrode 182. Accordingly, guide surfaces 181*a* and 182*a* each of which is formed as a tilt surface or a curved surface may be formed in a facing manner at an upper edge of an inner circumferential surface of the movable-side arc electrode 182 and a lower edge of an outer circumferential surface of each fixed-side arc electrode 181, so as to guide the inner circumferential surface of the movable-side arc electrode 182 to be inserted into the outer circumferential surface of the fixed-side arc electrode 181.

Alternatively, the fixed-side arc electrode 181 may not be formed in a cylindrical shape. For example, as illustrated in FIG. 4, both of the fixed-side arc electrodes 181 may come in contact at an almost one point with the inner circumferential surface of the movable-side arc electrode 182. Accordingly, the fixed-side arc electrodes 181 and the movable-side arc electrode 182 may be formed only at portions where the fixed-side arc electrodes 182 and the movable-side arc electrode 182 come in contact with each other. In this instance, the fixed-side arc electrodes 182 or the movable-side arc electrode 182 may preferably be fixed in a welding manner or by a separate coupling member 185, such as a bolt. Of course, one of the fixed-side arc electrode and the movable-side arc electrode may be formed in a cylindrical shape so as to be press-fit into a corresponding contact, and only the other may be formed in a non-cylindrical shape so as to be fixed by a coupling member.

Hereinafter, operation effects of the high voltage relay device for the electric vehicle having such arc electrodes according to the embodiment will be described.

Figure 5:
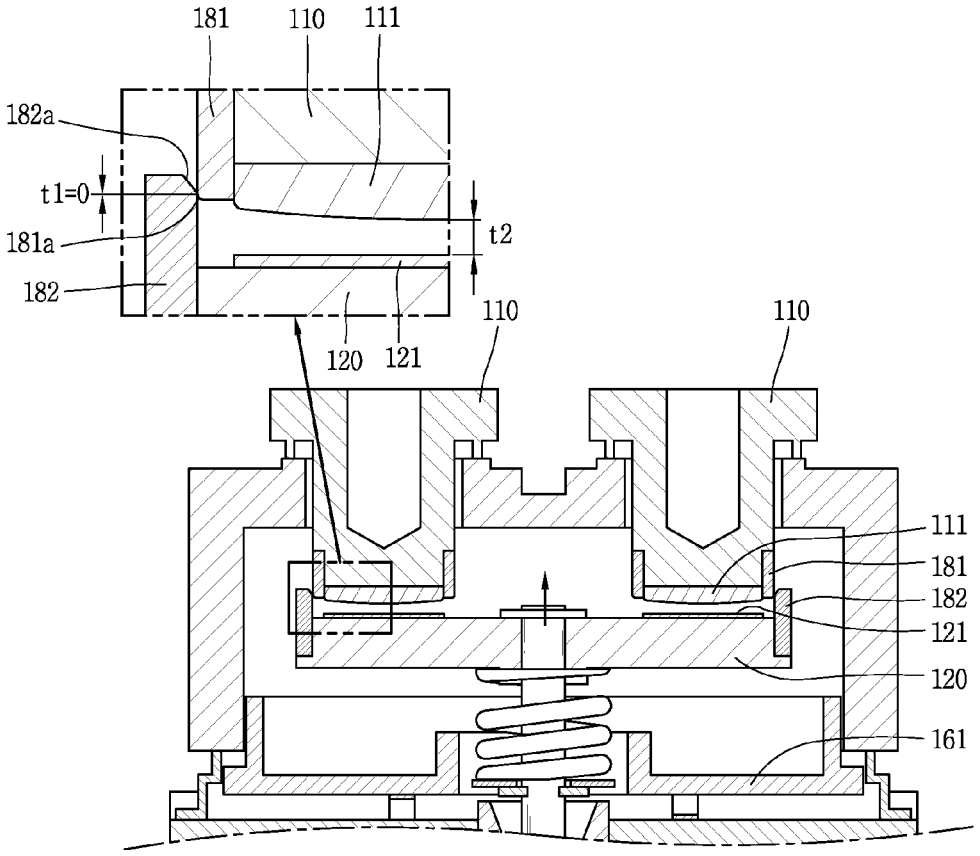
FIGS. 5 and 6 are longitudinal sectional views illustrating relationship between contacts and arc electrodes during a current-flowing (conductive) state and a current-cutoff (broken) state according to FIG. 2.

As illustrated in FIG. 5, when the movable contact arm 120 is moved toward the fixed electrodes 110, the movable contact 121 may be brought into contact with the fixed contacts 111, thereby allowing a flow of current. During this, arc may be generated between the fixed contacts 111 and the movable contact 121. However, the fixed-side arc electrodes 181 may be installed at the fixed electrodes 110 and the movable-side arc electrode 182 may be installed at the movable contact arm 120. Accordingly, the fixed-side arc electrodes 181 and the movable-side arc electrode 182 may be brought into contact with each other before the fixed contacts 111 and the movable contact 121 are brought into contact with each other.

That is, the fixed-side arc electrodes 181 and the movable-side arc electrode 182 are in contact with each other and the interval t1 between the two arc electrodes 181 and 182 becomes zero (0) accordingly, but the fixed contacts 111 and the movable contact 121 may still be spaced apart from each other by the predetermined interval t2.

Accordingly, arc may be generated between the fixed-side arc electrodes 181 and the movable-side arc electrode 182, thereby preventing the generation of the arc between the fixed contacts 111 and the movable contact 121 having relatively low resistance to arc.

Here, the fixed-side arc electrodes 181 and the movable-side arc electrode 182 may be formed of a material with resistance to arc, and thus general durability of the high voltage relay device can be improved more than a relay in which the arc is generated between the fixed contacts and the movable contact.

Figure 6:
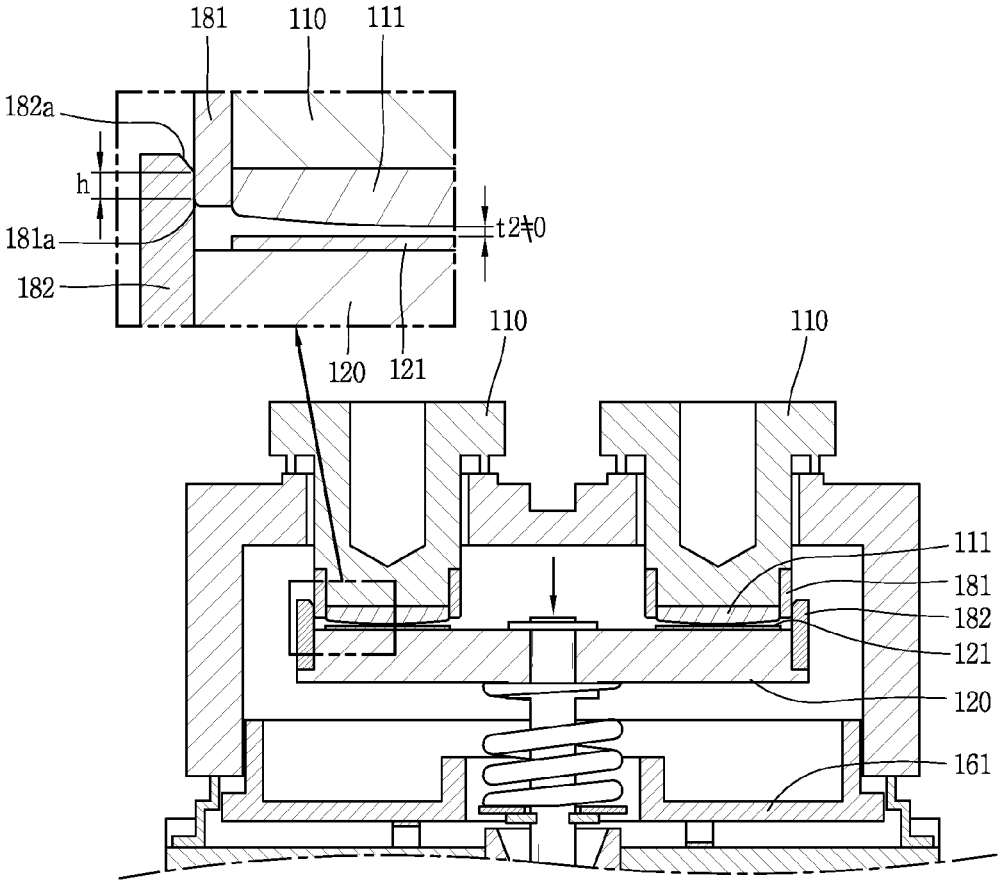

On the other hand, as illustrated in FIG. 6, when the movable contact arm 120 is moved away from the fixed electrodes 110, the movable contact 121 may be separated from the fixed contacts 111, thereby blocking a flow of current. In this instance, the fixed contacts 111 and the movable contact 121 are already spaced by the predetermined interval (t2≠0), but the fixed-side arc electrodes 181 and the movable-side arc electrode 182 may still be in a contact state by the predetermined height h.

Accordingly, as the fixed-side arc electrodes 181 and the movable-side arc electrode 182 are separated from each other later than the fixed contacts 111 and the movable contact 121, the arc may be generated between the fixed-side arc electrodes 181 and the movable-side arc electrode 182 which have relatively high resistance to arc. This may prevent the generation of the arc between the fixed contacts 111 and the movable contact 121, thereby improving durability of the high voltage relay device.

What is claimed is:

1. A high voltage relay device comprising:

fixed contacts;

a movable contact provided at one side of the fixed contacts and contactable with or separated from the fixed contacts;

fixed-side arc electrodes coupled to the fixed contacts; and a movable-side arc electrode coupled to one side of the movable contact and contactable with or separated from the fixed-side arc electrodes when the movable contact is brought into contact with or separated from the fixed contacts, wherein the fixed-side arc electrodes and the movable-side arc electrode are brought into contact with each other before the fixed contacts and the movable contact are brought into contact with each other and separated from each other after the fixed contacts and the movable contact are separated from each other.

2. The device of claim 1, wherein an interval between the fixed-side arc electrodes and the movable-side arc electrode is shorter than an interval between the fixed contacts and the movable contact.

3. The device of claim 2, wherein an inner circumferential surface of the movable-side arc electrode is brought into contact with outer circumferential surfaces of the fixed-side arc electrodes in a sliding manner.

4. The device of claim 1, wherein the fixed-side arc electrodes and the movable-side arc electrode are made of a material with heat resistance or abrasion resistance higher to that of a material forming the fixed contacts and the movable contact.

5. The device of claim 1, wherein the fixed contacts and the movable contact are made of a material with conductivity higher to that of a material forming the fixed-side arc electrodes and the movable-side arc electrode.

6. A high voltage relay device comprising:

fixed electrodes each having a fixed contact;

a movable contact arm having a movable contact that performs a relative motion with respect to fixed contacts of the fixed electrodes to be contactable with or separated from the fixed contacts;

an arc-extinguishing unit provided to accommodate the fixed electrodes and the movable contact arm and capable of extinguishing arc generated when the fixed contacts and the movable contact are brought into contact with or separated from each other;

a driving unit capable of driving the movable contact arm;

fixed-side arc electrodes coupled to the fixed electrodes; and a movable-side arc electrode coupled to the movable contact arm and contactable with or separated from the fixed-side arc electrodes so as to configure a part of the arc-extinguishing unit, wherein a stepped surface is formed on at least one of an outer circumferential surface of each of the fixed electrodes, or on an outer circumferential surface of the movable contact arm, and wherein each of the fixed-side arc electrodes or the movable-side arc electrode is coupled to the stepped surface in an inserting manner.

7. The device of claim 6, wherein the fixed-side arc electrodes and the movable-side arc electrode are formed in a cylindrical shape.

8. The device of claim 6, wherein at least one of the fixed-side arc electrodes, or the movable-side arc electrode, is coupled to only a part of an outer circumferential surface of a corresponding one of the fixed electrodes or the movable contact arm.

9. The device of claim 6, wherein the fixed-side arc electrodes and the movable-side arc electrode are formed in a cylindrical shape.

10. The device of claim 6, wherein an interval between the fixed-side arc electrodes and the movable-side arc electrode is shorter than an interval between the fixed contacts and the movable contact, and wherein an inner diameter of the movable-side arc electrode is greater than an outer diameter of each of the fixed-side arc electrodes, such that an inner circumferential surface of the movable-side arc electrode and an outer circumferential surface of each of the fixed-side arc electrodes are brought into contact with each other in an overlapping manner.

11. The device of claim 10, wherein the fixed-side arc electrodes and the movable-side arc electrode are formed in a cylindrical shape.

12. The device of claim 10, wherein at least one of the fixed-side arc electrodes, or the movable-side arc electrode, is coupled to only a part of an outer circumferential surface of a corresponding one of the fixed electrodes or the movable contact arm.

13. The device of claim 10, wherein guide surfaces each in an inclined or curved shape are formed at a lower edge of the outer circumferential surface of each of the fixed-side arc electrodes and an upper edge of the inner circumferential surface of the movable-side arc electrode, respectively.

14. The device of claim 13, wherein the fixed-side arc electrodes and the movable-side arc electrode are formed in a cylindrical shape.

15. The device of claim 13, wherein at least one of the fixed-side arc electrodes, or the movable-side arc electrode, is coupled to only a part of an outer circumferential surface of a corresponding one of the fixed electrodes or the movable contact arm.

* * * * *